United States Patent [19]

Antinora

[11] Patent Number: 4,895,333

[45] Date of Patent: Jan. 23, 1990

[54] DRAPERY TIEBACK SUPPORT

[76] Inventor: James P. Antinora, 76 South Vincent, Apt. #56, Upland, Calif. 91786

[21] Appl. No.: 174,220

[22] Filed: Mar. 28, 1988

[51] Int. Cl.[4] ..... A47H 13/01

[52] U.S. Cl. ..... 248/289.1; 248/558; 248/298; 248/300

[58] Field of Search ..... 248/289.1, 298, 287, 248/558, 316.4, 300; 160/349.2, 349.1; 403/103, 96, 92–94; 16/239, 297, 381, 354, 266, 262

[56] References Cited

U.S. PATENT DOCUMENTS

| | | | |
|---|---|---|---|
| 577,449 | 2/1897 | Preuss et al. | 160/349.2 |
| 1,518,824 | 12/1924 | Smith | 160/349.2 |
| 1,525,533 | 2/1925 | Brown | 248/289.1 X |
| 1,562,456 | 11/1925 | Klang | 248/289.1 |
| 1,593,156 | 7/1926 | Barsch | 160/349.2 |
| 2,053,332 | 9/1936 | Gossner | 160/349.2 |
| 2,190,764 | 2/1940 | Arnold | 160/349.2 |
| 2,242,478 | 5/1941 | Pekarz . | |
| 2,301,631 | 11/1942 | Lemieux . | |
| 2,405,354 | 8/1946 | Hansen et al. | 160/349.2 |
| 2,431,934 | 12/1947 | Higgins . | |
| 2,584,224 | 2/1952 | Pfaffko | 160/349.2 |
| 2,817,400 | 12/1957 | Cavage . | |
| 3,420,289 | 1/1969 | Bejarano | 160/349.2 |
| 4,022,415 | 5/1977 | Roderick et al. | 160/349.2 |
| 4,343,344 | 8/1982 | Shelton | 160/349.2 |
| 4,559,988 | 12/1985 | Nocerino | 160/349.2 |

*Primary Examiner*—Robert W. Gibson, Jr.
*Assistant Examiner*—Karen J. Chotkowski
*Attorney, Agent, or Firm*—Sheldon & Mak

[57] ABSTRACT

A support for holding a tieback and return of a drapery comprises a base for mounting to a vertical structure, a pivotal support plate attached to the base, and one or two extension arms attachable to the support plate. By use of the pivoting plate and the two extension arms, single support can be use for holding two tiebacks such as at an inside or outside corner.

28 Claims, 3 Drawing Sheets

DRAPERY TIEBACK SUPPORT

BACKGROUND

This invention relates in general to devices for supporting drapery along a vertical structure such as a wall.

It is commonplace to hang a drapery along a window opening or wall with the vertically extending folds gathered on each side and held back in a decorative fashion by means of a tieback. Such tiebacks can be of a rigid material such as a wood or metal or of a flexible material such as a material matching the drapery. In many cases it is desirable to support the return portion of the drapery from the wall so that the return folds are not crushed against the wall. Among the prior art devices which have been employed for this purpose are the drapery holders disclosed in U.S. Pat. Nos. 3,420,289 and 4,022,415. The devices disclosed by these patents, the tieback and drapery return are supported by a bracket which is affixed at one end to the wall and has an arcuate outer end In one embodiment an adjustable bracket is provided in which inner and outer sections are both attached to an intermediate plate.

The drapery tiebacks are conventionlly secured to prior art holders by means of pin hooks Which engage eyelets attached to the ends of the tieback.

Conventional holders of the type described have a number of limitations and drawbacks. For example, with side-by-side windows, or where draperies meet at an inside or outside corner, two separate tiebacks are needed, one for each drapery. It is difficult, expensive, and time consuming to install two holders next to each other. Moreover, at an outside corner an unsightly gap betWeen adjoining draperies results, while in an inside corner there can be an unsightly overlap.

Another problem with existing holders is that it is difficult to pin the tiebacks to the holders using the pin hooks, particularly when the holder is located in a corner.

SUMMARY

The present invention is directed to a support for holding a tieback and return of a drapery that overcomes this and other problems of prior art supports. The support is used for holding the tieback and return in a desired position in relation to a vertical structure such as a wall, with the drapery hanging down along the wall in vertically extending folds with the return projecting towards the wall. The support comprises a base that includes a mounting flange for mounting to the vertical structure. A support plate is attached to the base to project outwardly from the structure. A first extension arm has a proximate portion for attachment to the support plate and an outer end for supporting a portion of the tieback and return. The support includes means for adjustably securing the first extension arm to the support plate so that the distance between the outer end of the first extension arm and the structure can be adjusted for controlling the spacing between the drapery and the structure.

In one version of the invention, the support includes pivot means for pivoting the support plate relative to the base so that the support plate can swivel and project from the structure at a desired angle. The support also includes means for locking the support plate relative to the base at the desired angle. This pivoting feature is useful when using the support at a corner of the structure, so that the base can be mounted on any convenient surface and the extension arm can then be pivoted to any convenient and attractive location.

In another version of the invention, which can be used with the first version, the support includes a second extension arm for supporting a portion of another tieback and return so that the support can be used for two draperies such as at a corner of the structure The second arm, like the first arm, has a proximal portion for attachment to the support plate and a distal or outer end for supporting the other tieback and return. In this version, the support also includes means for adjustably securing the second extension arm to the support plate so that the distance between the outer end of the second extension arm and the structure can be adjusted. The support also includes means for maintaining the outer ends of the two extension arms spaced apart from each other a sufficient distance that the two tiebacks and two returns can fit between the two arms.

The outer end of each attachment arm is provided with a transverse flange with a curved edge to support the tieback and to avoid unsightly gaps when the support is used for two drapes. The transverse flanges face away from each other.

Preferably the two extension arm are substantially identical so that they are interchangeable, and preferably the second arm is removable to that the support can be used for either one or two draperies.

To achieve secure and stable mounting to the structure, preferably the height of the mounting flange is greater than the height of the support plate.

For ease in installation, preferably the support plate includes a toothed projection to which one end of the tieback can be secured.

The pivot means can comprise a pivot pin extending through the bore of a hinge bracket on the support plate and the aligned bore of a hinge bracket on the mounting flange. With this structure, the locking means can comprise a plurality of longitudinally extending grooves in each bore and at least one cooperating radially extending projection on the pin so that when the pin projection extends into aligned grooves of each hinge bracket, relatively pivoting between the support plate and the mounting flange is impossible. Preferably there are at least five grooves in each bore so that the extension arms can be locked in any one of five angles relative to the structure. More preferably, there are eight grooves so the extension arms can be locked in positions varying from each other in 45 increments.

DRAWINGS

These and other features, aspects, and advantages of the present invention will become better understood with reference to the following description, appended claims, and accompanying drawings where:

DESCRIPTION

Figure 2B:
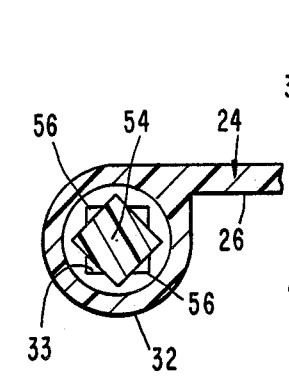
FIG. 2B is a transverse sectional view of the hinge mechanism taken on line 2B—2B of FIG. 2A.

In the drawings, a drapery tieback support 10 having features of the present invention is mounted on a wall 12 or other generally vertical structure for supporting a tieback 14 used in conjunction with drapery 16. The drapery 16 can be of any conventional decorative material and is hung by a suitable traverse rod (not shown) or other support along a window opening, door frame or the like. The drapery hangs down in a number of folds 17 or convolutions having a dimension, known as the return, which extends towards the wall 12 or structure. The folds or return 17 on opposite sides of the drapery are each gathered and drawn to the side by tiebacks 14 which are comprised of a suitable flexible material, such as a decorative material matching the drapery and which includes an inner lining of a suitable material such as buckram The two ends 18 and 20 of the tieback 14 as well as the outermost fold 22 of the drapery 16 are mounted on the support 10 in a manner to be described.

Figure 2A:
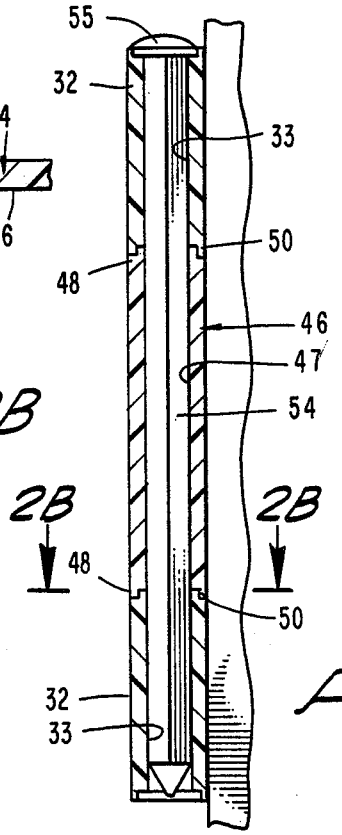
FIG. 2A is a longitudinal sectional view of the hinge mechanism of the support used for pivoting the support plate to the base of the support of FIG. 1 taken on line 2A—2A of FIG.
Figure 2C:
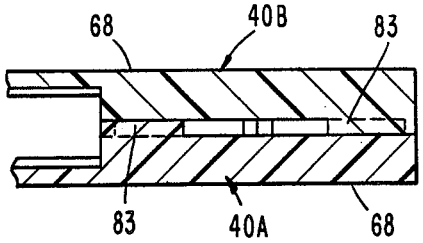
FIG. 2C is a transverse sectional view of the two extension arms of the hinge assembly of FIG. 1 taken on line 2C—2C of FIG. 1.
Figure 1:
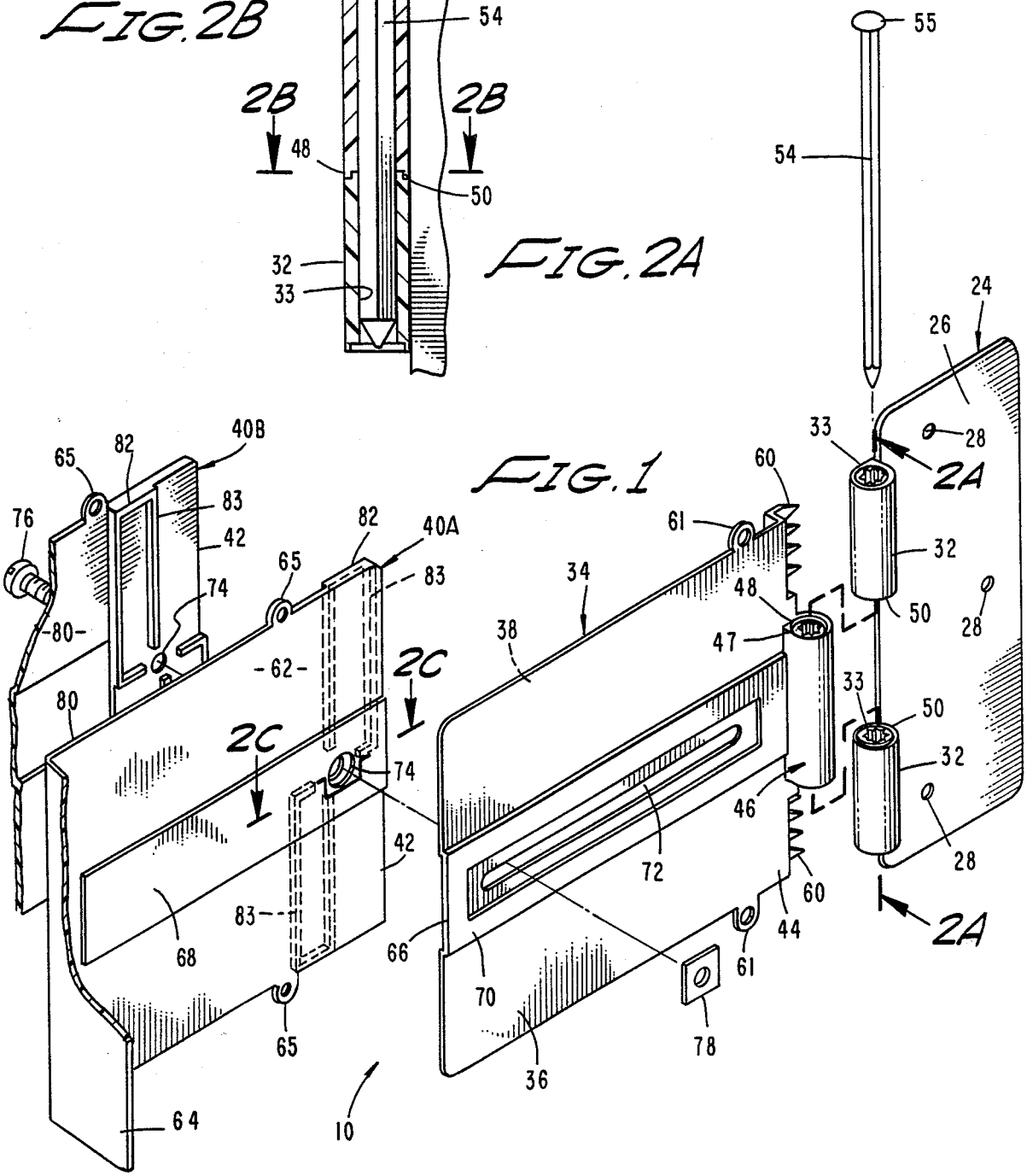
FIG. 1 is an, exploded perspective view of a two-arm tieback support having features of the present invention.

With reference to FIGS. 1 and 2, the support 10 includes a base 24 adapted to be mounted on the wall 12 or other vertical structure. The base 24 comprises a flat mounting flange 26 having a plurality of circular openings 28 therein for receiving screws 30 or other fasteners for securely attaching the base 24 to the wall 12. The base 24 includes a pair of spaced apart hinge brackets 32 along one edge of the mounting flange 26, the brackets 32 projecting away from the wall 12. Each bracket 32 has an internal bore 33.

The support 10 includes a support plate 34 attached to the base 24 to project outwardly from the wall 12. The support plate 34 has opposed surfaces, an outer surface 36 and an inner surface 38. As described in detail below, attached to the inner surface 38 is one or two extension arms, a first extension arm 40A and optionally a second extension arm 40B.

The support plate 34 has mounted on its proximal end, i.e., the end proximal to the wall 12 when the support is mounted in place, a hinge bracket 46 complementary to the hinge brackets 32 of the base 24. The hinge bracket 46 is sized to snap fit in between the two hinge brackets 32 of the base 24. The outside end edges 48 of the support plate hinge bracket 46 are slightly chamfered or hollowed out to receive snap fit extensions 50 on the outside end of each hinge bracket 32. The support hinge bracket 46 has an internal bore 47 aligned with the internal bores 33 of the base hinge brackets 32. A hinge locking pin 54 extends through the bores of the three hinge brackets, thereby holding the support plate and base 24 together. The pin 54 has a top or cap 55 of a larger diameter than the bores 33 and 47. The pin 54 is aligned vertically in use and is oriented with the cap 55 on top so that the pin stays in place. If desired, locking means (not shown) can be used to make sure the pin 54 is not inadvertently removed.

As can be appreciated, the support plate 34, and thus the extension arms 40A and 40B, can be pivoted to any desired position relative to the wall 12. A locking mechanism is provided to maintain the support plate 34 and the extension arms 40A and 40B in a desired position. In a preferred version of the invention, as shown in FIG. 2, the locking means comprises a plurality of longitudinally extending grooves 56 in each hinge bore 33 and 47. There are eight equidistantly spaced apart grooves, forming in vertical cross-section an eight-pointed star. The locking pin 54 is square in cross-section with corners sized to project into aligned grooves of each hinge bracket, thereby making relative pivoting between the support plate and the base impossible. Although the projecting corner edges on the pin 54 are shown as one continuous ridge, all that is required for the locking mechanism is at least one projection that extends into a groove 56 of the support plate hinge bracket bore 47, and another projection extending into a groove in each base hinge bracket bore 33. In other words, instead of one long extending corner projection, three spaced apart separate projections can be used to achieve locking of the support plate 34 relative to the base 24.

The support plate 34 has on its proximal end 44 on both sides of the hinge bracket 46 a pair of tieback grabbers 60 comprising an inwardly projecting tooth edge adapted to grab onto the tieback without need for a pin or other attachment means. The top and bottom edge of the support plate are each provided with a hook, eyelet, loop, ear 61, or other structure for receiving a pin for attachment of a tieback.

The extension arms 40A and 40B are substantially identical so that they are interchangeable. Each extension arm 40 is formed with a flat panel 62 with a transverse flange 64 having a radiused edge around which the outermost fold of the return is supported. The top and bottom edges of each extension are provided with ears 65, identical to the ear 61 on the support plate 34, to which one end of the tieback 14 can be attached with a pin (not shown). The ears 65 can be used in lieu of the grabbers 60.

Cooperative guide means are formed on both the support plates 34 and the extension arm 40 The support plate 34 has a longitudinally extending, centrally located recess 66 on its inner surface 38, into which slidingly fits a corresponding longitudinal ridge 68 on the extension arm. The support plate outer surface 36 has a corresponding longitudinal reinforcing rib 70 to compensate for the structural weakness resulting from the recess 66. The cooperating recess 66 and ridge 68 prevent relative vertical motion between the extension arms 40 and the support plate 34 where the support 10 is assembled.

Openings are formed in the support plate 34 and both extension arms 40 for assembling the parts together in such a way that the distance between the outer end 42 of each extension arm and the wall 12 can be adjusted. The support plate 34 has an elongate slot 72 through the recess 66. Each extension arm 40 has a circular opening 74 through the rib 70 proximate the end of the extension arm mounted closest to the wall. A fastener such as a screw 76 extends through the circular opening 74 of the first extension arm 40A, or through the circular openings of both extension arms when both extension arms are used, and then through the elongate slot 72 of the support plate 34 when assembling the parts. The screw is held in place by a nut 78. The circular openings 74 are provided with an enlarged entry such that the head of the screw 76 is flush with the surrounding surface. Similarly the support recess 72 is sufficiently wide that the nut 78 is flush with the surrounding surface. It is necessary that the back-to-back surfaces 80 of the extension arms 40, i.e., the surfaces 80 opposite from the direction in which the transverse flange 64 extends, be spaced apart from each other and include means to prevent relative vertical motion between the two extension arms. The spacing is required so that two tiebacks and two returns can fit between the extension arms 40. The locking mechanism is needed so that the second extension arm cannot be displaced vertically from the first extension arm. As discussed above, the first extension arm locks with the support plate so that vertical movement between the first extension arm 40A and the support plate 34 is impossible.

This result is achieved with interlocking projections on the back-to-back faces 80. Generally the proximal portions 82 of the adjoining faces 80 of the extension arms 40 are raised about a quarter of an inch to provide a half inch gap between the distal portions of the extension arms 40 when the support 10 is assembled In addition, the proximal portions 82 are provided with two sets of offset ribs 83, each set of ribs being generally rectangular in shape in plan view, so that when the extension arms are assembled, the ribs interlock preventing both relative vertical and horizontal movement between the extension arms 40.

Figure 3:
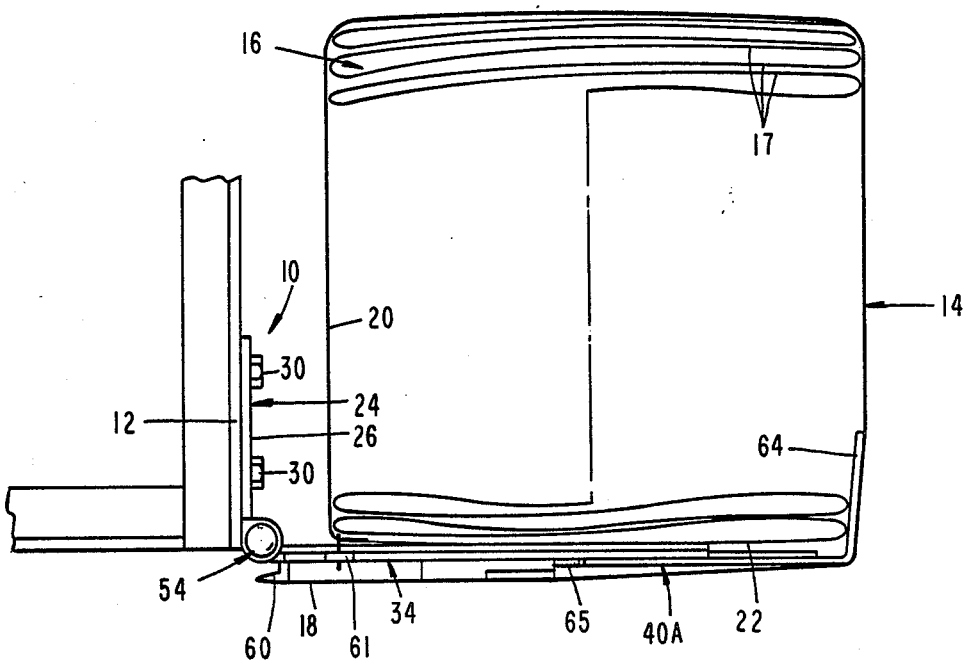
FIG. 3 is a top plan view of a support as shown in FIG. 1, with only one extension arm, being used for supporting a tieback and return of a drape.

FIG. 3 shows the use of the holder 10 when only a single extension arm 40A is used. The base 24 is mounted against the wall with screws 30 projecting through the openings 28 in the base mounting flange 26. The support plate 34 is attached to the base 24 with the locking pin 54 such that the support plate 34 is at a right angle to the wall 12. The extension arm 40 is attached to the support plate 34 so that its transverse flange 64 extends toward the drapery 16 in the same direction as which the mounting flange 26 extends, i.e., typically inwardly toward a window. The position of the extension arm 40 relative to the wall 12 is adjusted by sliding the extension arm 40 on the support plate 34, securing it in a desired position with the screw 76 and nut 78. Before tightening the screw 76 and nut 78, the extension arm can be slid along the support plate 34 with the extension arm ridge 68 sliding in the support recess 66. Thus the assembly of the extension arm onto the support plate, and the assembly of the support plate on the base 24, can be rapidly accomplished with a minimum of difficulty.

Next, the return folds of the side of the drapery are gathered and pulled to one side with the tieback 14 being partially wrapped around the return. The side margin of the outer fold 22 of the drapery is wrapped around the transverse flange 64 and placed alongside the outer surface of the extension arm and support plate, with the first end 18 of the tieback being wrapped around the outer fold 22 of the drapery and grabbed by the tieback grabber 60, or alternatively pinned to the ears 65 of the extension arm 40. The second end 20 of the tieback 14 is brought back and pinned to the ears 61 of the support plate 34.

In FIG. 3 the extension arm is shown at its minimum extension relative to the wall 12. If it was desired to support the drapery in combination with a sheer curtain, the extension arm 40 can be extended to its extended position so that a sheer curtain (not shown) can be supported on its transverse rod so as to freely hang down in the space between the return and the wall.

Figure 4:
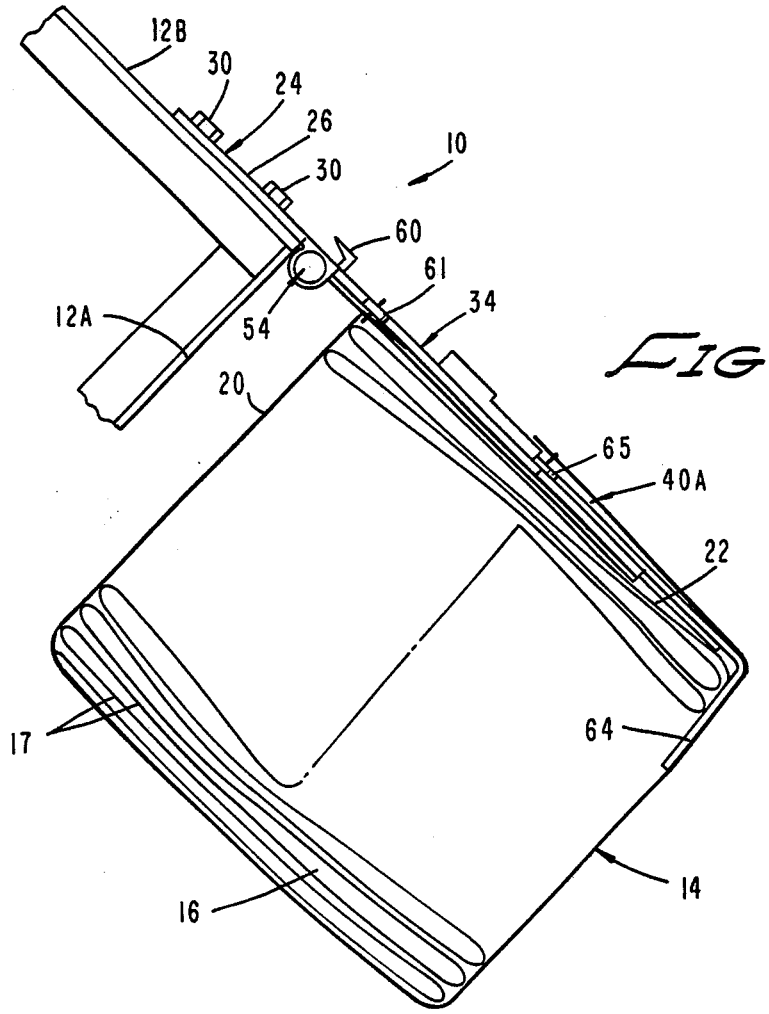
FIG. 4 is a top plan view of the support of FIG. 3 in use for holding a tieback and return of a drape at a corner of a structure where two walls meet, where the base is mounted to one wall while the extension arm holds the tieback and return away from the other wall.

FIG. 4 shows the present invention being used to solve a common problem, namely inability to mount a support on the wall covered by the draperies. This can occur, for example, when draperies are being used on a window that extends substantially to a corner or where a wall covered is unsuitable for receiving a mounting flange 26. As shown in FIG. 4, the base 24 is mounted against a second wall 12B rather than the wall 12A over which the drapery 16 hangs. The support plate 34 is locked in a position relative to the base 24 so that they are in substantially the same plane, with the support plate 34 and extension arm 40 being parallel to the wall 12B and perpendicular to the wall 12A as desired.

Figure 5:
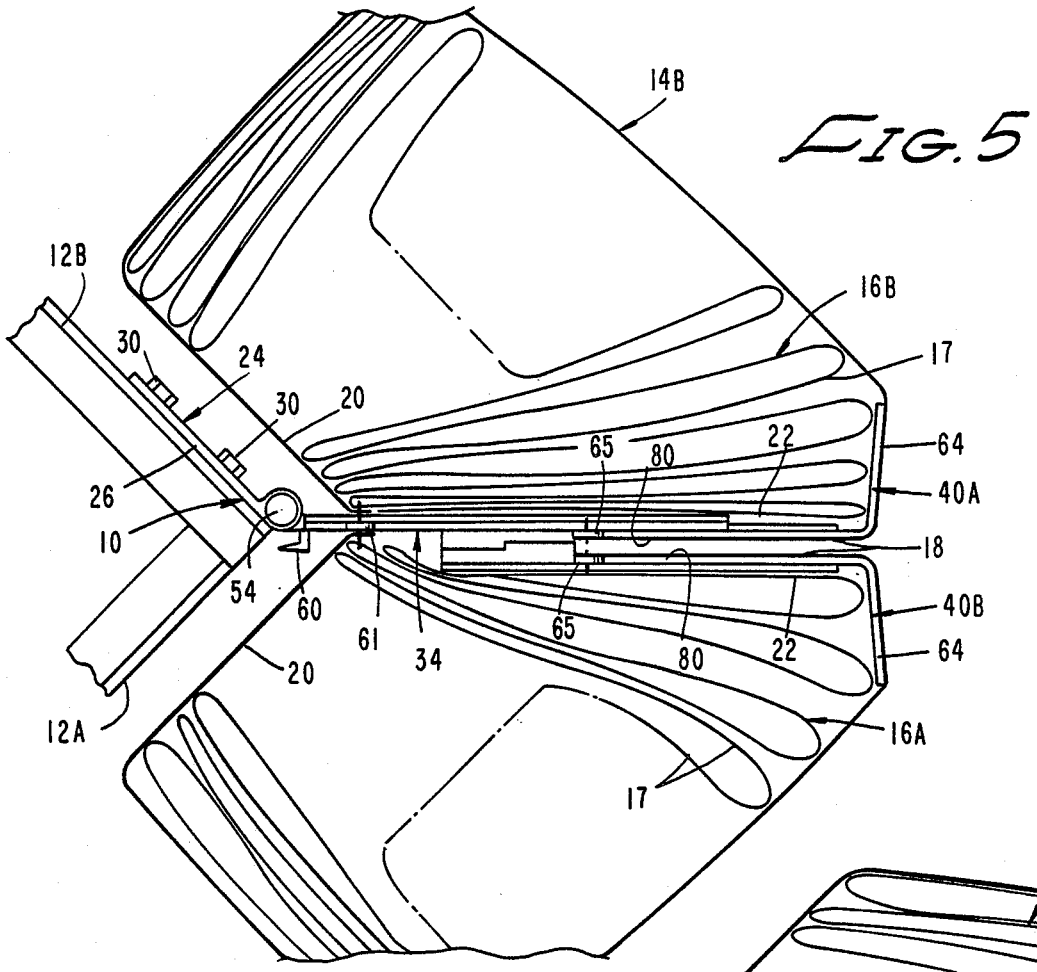
FIG. 5 is a top plan view of the support of FIG. 1 being used a tieback and return for two drapes at an inside corner.

FIG. 5 shows the present invention being used to solve a common problem, namely securing tiebacks at an outside corner where two sets of draperies meet. In this version, the base 24 is attached to the second wall 10B and the support plate 24 is locked in position relative to the base 24 so that the support plate and both extension arms are at an angle of about 45 degrees relative to the each wall 12A and 12B. Medium extension or the arms is used. The first tieback 14A is used on first drapery 16A and attached to the first extension arm 40A. while the second tieback 14B is used with the second drapery 16B and the second extension arm 40B. The space between the distal ends of the two extension arms is sufficient that the two tiebacks 14A and 14B and the outer fold 22 of each drapery can fit between the extension arms and be secured in place. Note that with the use of a holder 10 according to the present invention, there is no gap between the draperies at the outside corner of FIG. 5.

Figure 6:
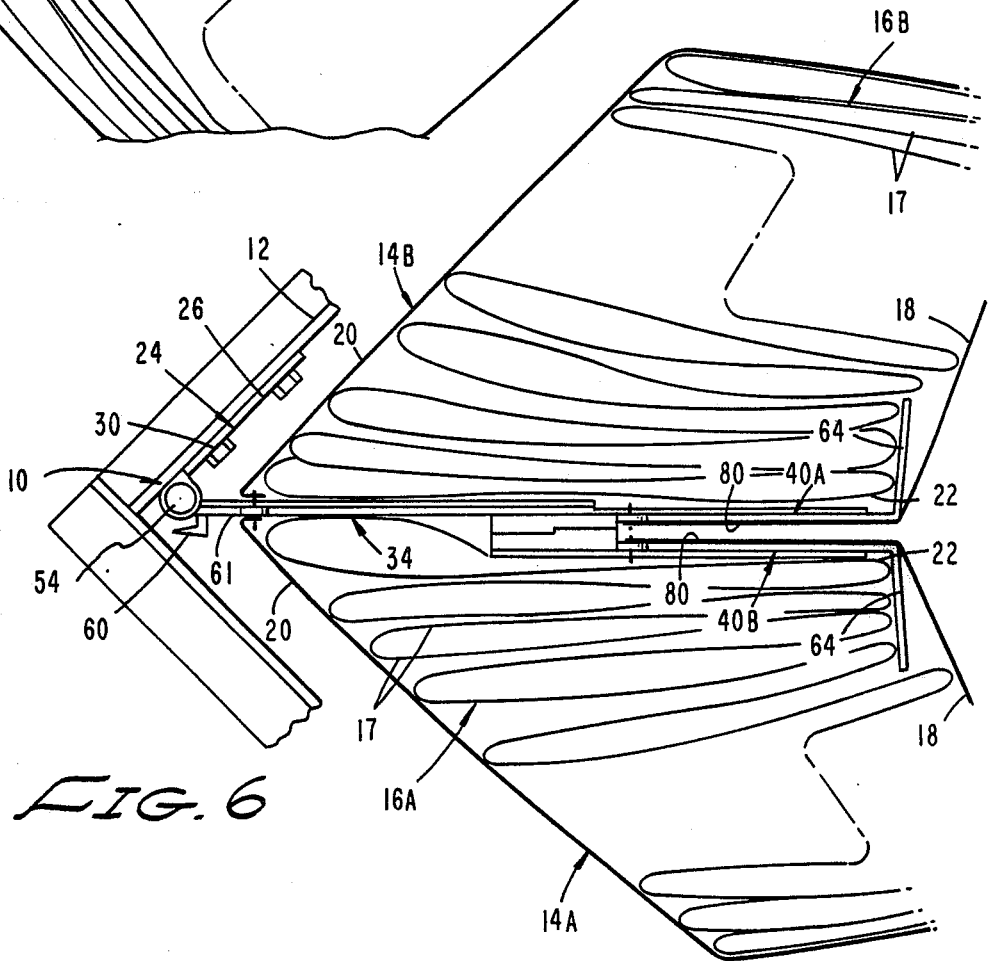
FIG. 6 is a top plan view of the support of FIG. 1 being used for holding a tieback and return for two drapes at an outside corner.

FIG. 6 shows the use of a holder having features of the present invention at an inside corner. It is used substantially the same as is the holder shown in FIG. 5, again with the result that there is no unsightly gap between the draperies.

The components of the support can be made of a variety of materials, including light weight rigid materials such as aluminum, or rigid plastics. Preferably an injection molded plastic such as high density polyethylene or an acrylic can be used.

The present invention has many advantages. As discussed above, it provides a stable and rigid support for a tieback. For this purpose, the height of the mounting flange 26 is preferably greater than the height of the support plate 34 to provide a secure and stable mount to the wall 10. The support is easy to use, and as shown in FIG. 4, it can be used even where the wall covered by the drapery cannot accommodate a conventional tieback holder. Further, only a single holder is needed at corners, while with prior holders two separate holders are needed at corners. Moreover, as shown in FIGS. 5 and 6, unsightly gaps at corners are eliminated. The use of substantially no curvature at the outer end of the extension arms helps eliminate such a gap. The holder 10 is easy to use, greatly reducing installation time for tiebacks. The built-in tieback grabbers contribute to the ease of use of the holder 10.

Although the present invention has been described in considerable detail with reference to certain preferred versions thereof, other versions are possible. For example, by using a different locking mechanism, the support or swivel plate 34 can be made integral with the base 24. Although in the preferred version the holder has a capability of being used with two extension arms and has a pivot feature, the invention also contemplates a holder capable of holding two extension arms, such as a fixed 45 degree angle, without the adjustable pivoting feature. Therefore the spirit and scope of the appended claims should not be limited to the description of the preferred versions contained herein.

What is claimed is:

1. A support for holding a tieback and return of a drapery in relationship to a vertical structure such as a wall, the drapery hanging down along the structure in vertically extending folds with the return projecting toward the structure, the tieback having first and second ends, the support comprising:

(a) a base comprising a mounting flange for mounting to the vertical structure;

(b) a support plate for attachment to the base to project outwardly from the structure, (c) pivot means for pivoting the support plate relative to the base so the support plate projects from the structure at a desired angle, the pivot means comprising a pivot pin extending through the bore of a hinge bracket on the support plate and the aligned bore of a hinge bracket on the mounting flange;

(d) means for locking the support plate relative to the base at the desired angle;

(e) means for removably attaching the first end of the tieback to the support; and (f) means for independently and removably attaching the second end of the tieback to the support.

2. A support for holding a tieback and return of a drapery in relationship to a vertical structure such as a wall, the drapery hanging down along the structure in vertically extending folds with the return projecting toward the structure, the tieback having first and second ends, the support comprising:

(a) a base comprising a mounting flange for mounting to the vertical structure;

(b) a support plate for attachment to the base to project outwardly from the structure;

(c) pivot means for pivoting the support plate relative to the base so the support plate projects from the structure at a desired angle;

(d) means for locking the support plate relative to the base at the desired angle;

(e) means for removably attaching the first end of the tieback to the support;

(f) means for independently and removably attaching the second end of the tieback to the support;

(g) a first extension arm having a proximal portion for attachment to the support plate and an outer end for supporting a portion of the tieback and return;

(h) means for adjustably securing the first extension arm to the support plate so that the distance between the outer end of the first extension arm and the structure can be adjusted;

(i) a second extension arm for supporting a portion of another tieback and return so that the support can be used for two draperies such as at a corner of the structure, the second extension arm having a proximal portion for attachment to the support plate and an outer end for supporting the other tieback and return;

(j) means for adjustably securing the second extension arm to the support plate so that the distance between the outer end of the second extension arm and the structure can be adjusted; and (k) means for maintaining the outer ends of the two extension arms spaced apart a sufficient distance that the two tiebacks and two returns can fit between the two arms.

3. A support for holding a tieback and a return of each of two draperies in relationship to a vertical structure such as a wall, the draperies hanging down along the structure in vertically extending folds with the return projecting toward the structure, the support comprising:

(a) a base comprising a mounting flange for mounting to the vertical structure;

(b) a first extension arm having a proximal portion for attachment to the base and an outer end for supporting a portion of a first tieback and return;

(c) means for adjustably securing the first extension arm to the base so that the distance between the outer end of the first extension arm and the structure can be adjusted;

(d) a second extension arm for supporting a portion of another tieback and return so that the support can be used for two pair of draperies such as at a corner of the structure, the second extension arm having a proximal portion for attachment to the base and an outer end for supporting a second tieback and return;

(e) means for maintaining the outer ends of the two extension arms spaced apart a sufficient distance from each other that the two tiebacks and two returns can fit between the two arms; and (h) means for adjustably securing the second extension arm to base plate so that the distance between the distal end of the second extension arm and the structure can be adjusted.

4. A support for holding a tieback and a return of each of two draperies in relation to a vertical structure such as two walls meeting at a corner, the draperies hanging down along the structure in vertical extending folds with the returns projecting towards the structure, the support comprising:

(a) a base comprising a mounting flange for mounting to the vertical structure;

(b) a support plate for attachment to the base to project outwardly from the structure;

(c) pivot means for pivoting the support plate relative to the base so that the support plate projects from the structure at a desired angle;

(d) means for locking the support plate relative to the base at the desired angle;

(e) a pair of substantially identical extension arms, each extension arm having a proximal portion for attachment to the support plate and a n outer end having a transverse flange for supporting a portion of one of the tiebacks and returns, wherein when the support is assembled the flanges of the attachment arms extend away from each other;

(f) means for adjustably securing the two extension arms and the support plates together so that distance between the outer ends of the extension arms and the structure can be adjusted;

(g) means for maintaining the outer ends of the two extension arms spaced apart at sufficient distance from each other that the two tiebacks and two returns can fit between the two arms;

(h) means for preventing relative vertical movement between the extension arms and the support plate; and (i) means for preventing relative vertical and horizontal movement between the two extension arms.

5. A support for holding a tieback and return of a drapery in relationship to a vertical structure such as a wall, the drapery hanging down along the structure in vertically extending folds with the return projecting toward the structure, the tieback having first and second ends, the support comprising:

(a) a base comprising a mounting flange for mounting to the vertical structure;

(b) a support plate for attachment to the base to project outwardly from the structure;

(c) pivot means for pivoting the support plate relative to the base so the support plate projects from the structure at a desired angle;

(d) means for locking the support plate relative to the base at the desired angle;

(e) means for removably attaching the first end of the tieback to the support;

(f) means for independently and removably attaching the second end of the tieback to the support;

(g) an extension arm having a proximal portion for attachment to the support plate and an outer end for supporting a portion of the tieback and return, wherein the outer end of the extension has a transverse flange with substantially no curvature at the end of the transverse flange opposite the extension arm; and (h) means for adjustably securing the extension arm to the support plate so that the distance between the outer end of the extension arm and the structure can be adjusted.

6. The support of claim 1 including:

(e) an extension arm having a proximal portion for attachment to the support plate and an outer end for supporting a portion of the tieback and return; and (f) means for adjustably securing the extension arm to the support plate so that the distance between the outer end of the extension arm and the structure can be adjusted.

7. The support of claim 1 in which the locking means comprises a plurality of longitudinally extending grooves in each bore and at least one cooperating radially extending projection on the pin so that when the pin projection projects into aligned grooves of each hinge bracket, relative pivoting between the support plate and the base is impossible.

8. The support of claim 2 in which the means for removably attaching the first end of the tieback comprises a multiple-toothed grabber on the support plate for securing the first end of the tieback.

9. The support of claim 6 including means for preventing relative vertical motion between the first extension arm and the support plate when the first extension arm is attached to the support plate.

10. The support of claim 2 in which the height of the mounting flange is greater than the height of the support plate for secure and stable mounting to the structure.

11. The support of claim 2 installed on the structure with the mounting flange mounted to the structure, the structure comprising first and second walls meeting at a corner with the drapery hanging down along the first wall with the support plate attached to the second wall.

12. The support of claim 7 in which there are at least five grooves in each bore so that the extension arm can be locked at any one of at least five angles relative to the structure.

13. The support of claim 2 in which the outer end of each attachment arm has a transverse flange with the transverse flanges projecting away from each other when the extension arms are attached to the support plate.

14. The support of claim 2 or 13 in which the two extension arms are substantially identical so that they are interchangeable.

15. The support of claim 2 wherein the second arm is removable so the support can be used for one or two draperies.

16. The support of claim 2 in which the pivot means comprises a pivot pin extending through the bore of a hinge bracket on the support plate and the aligned bore of a hinge bracket on the mounting flange.

17. The support of claim 2 or 3 mounted to the structure, the structure comprising first and second walls meeting at a corner with a drapery hanging down along each wall, the support holding two tiebacks, one for each drapery.

18. The support of claim 3 in which the outer end of each attachment arm has a transverse flange with the flanges extending away from each other when the extension arms are attached to the support plate.

19. The support of claim 3 or 18 in which the two extension arms are substantially identical so that they are interchangeable.

20. The support of claim 3 comprising a support plate pivotally attached to the mounting flange, and both extension arms are attached to the support plate.

21. The support of claim 3 wherein both tiebacks have first and second ends, and the support comprises means for removably and independently attaching the first and second ends of both tiebacks thereto.

22. The support of claim 3 or 4 wherein the outer end of both extension arms has a transverse flange with substantially no curvature at the end of the transverse flange opposite the extension arms.

23. The support of claim 18 wherein the second arm is removable so that the support can be used for one or two sets of draperies.

24. The support of claim 20 in which the height of the mounting flange is greater than the height of the support plate for secure and stable mounting to the structure.

25. The support of claim 2 or 20 including means for preventing relative horizontal or vertical movement between the second extension arm and the first extension arm when the first and second extension arm are attached to the support plate.

26. The support of claim 20 including means for preventing relative vertical motion between the first extension arm the support plate when the first extension arm is attached to the support plate.

27. The support of claim 26 or 20 including means for preventing relative horizontal or vertical movement between the second extension arm and the first extension arm when the first and second extension arm are attached to the support plate.

28. The support of claim 21 in which the means for removably attaching the first end of the tieback comprises a multiple-toothed grabber on the support plate for securing the first end of the tieback.

* * * * *